United States Patent [19]

Reinhart

[11] 4,225,050

[45] Sep. 30, 1980

[54] TAMPER-PROOF BOTTLE CAPS AND METHOD OF FORMING SAME

[75] Inventor: Douglas M. Reinhart, Stratford, Conn.

[73] Assignee: Segen Industries, Inc., Devon, Conn.

[21] Appl. No.: 40,630

[22] Filed: May 21, 1979

[51] Int. Cl.[3] ..... B65D 41/34

[52] U.S. Cl. ..... 215/252; 264/156

[58] Field of Search ..... 215/252, 253; 264/156, 264/328

[56] References Cited

U.S. PATENT DOCUMENTS

| | | | |
|---|---|---|---|
| 3,460,703 | 8/1969 | Leftault | 215/252 |
| 3,504,818 | 4/1970 | Crisci | 215/252 |
| 3,874,540 | 4/1975 | Hidding | 215/252 |
| 3,904,061 | 9/1975 | Keeler | 215/252 |
| 4,153,174 | 5/1979 | Keeler | 215/252 |

*Primary Examiner*—Donald F. Norton
*Attorney, Agent, or Firm*—Thomas L. Tully

[57] ABSTRACT

A molded or formed tamper-proof cap adapted to be applied in unitary form to a container opening having a threaded neck and a ratchet retainer means associated with said threaded neck but being resistant to removal in unitary form from said container without separation of its parts. The present caps comprise a main cap body and an annular retainer skirt element which is coaxial with and has a larger diameter than said main cap body. Said retainer skirt element has a top surface comprising an annular horizontal flange and a cylindrical vertical side wall, said side wall being provided with angular engagement means adapted to slip over the ratchet retainer means present on the container when said cap is rotated onto the threaded neck of the container but to resist counter-rotation of said cap. The invention is characterized by providing said annular flange with at least one discontinuous transverse severance line which forms a segmented cut or circle which substantially surrounds the main cap body, the leading and trailing ends of said severance lines forming therebetween narrow bridging areas of said flange, which areas are flexible or weak in the direction of counter rotation of said cap.

6 Claims, 6 Drawing Figures

TAMPER-PROOF BOTTLE CAPS AND METHOD OF FORMING SAME

BACKGROUND OF THE INVENTION

This invention relates to the provision of molded plastic caps adapted to be screwed onto the threaded neck of a container to seal the same when not in use.

The increasing popularity of plastic containers and plastic caps used therewith, most particularly gallon-size containers used for milk, fruit drinks, distilled or mineral water, anti-freeze and a number of other products, has given rise to the requirement for tamper-proof caps which lock onto the container when first applied during the packaging of the contained product and which cannot be removed without producing some visible change in the appearance of the cap.

To this end, the plastic containers are conventionally formed with retainer means, such as ratchet teeth, surrounding the neck of the container below the external threads onto which the threaded cap is screwed. The internally-threaded cap is provided with a lower skirt which is releasably attached to the main cap body and which is provided with internal engagement means which are adapted to slip over the ratchet teeth and engage the same when the cap is screwed onto the container in a clockwise direction to seal the same. However, the cap cannot be unscrewed from the container without some change occurring in the appearance thereof.

Most such safety caps are injection molded with releasably-attached skirts having inwardly-projecting angular or slanted teeth which are designed to slip over the bottle neck ratchet when the cap is screwed onto the container but which resist reverse-rotation. Reference is made to U.S. Pat. Nos. 3,902,621 and 3,980,195 which disclose caps of this type on which the retainer skirt is provided with a pull-tab and is adapted to be pulled away from the cap to remove the locking means and adapt the cap to be freely unscrewed from the container. Such a pull-tab arrangement is effective for its intended purpose but has the disadvantage that it requires an operation, separate from the unscrewing operation, to permit the latter operation to be accomplished. Also, the removal of the pull-tab requires finger-tip strength and can result in breakage of the pull-tab and inconvenience to the user.

Reference is also made to U.S. Pat. Nos. 3,504,818 and 3,874,540 as representative of injection-molded safety caps having engagement skirts which are adapted to break away from the main cap during the initial removal of the cap from the container. Such caps do not require a separate operation to disengage the skirt but they do have the disadvantage of requiring sufficient applied strength to cause the retainer skirt to break away from the main cap before the main cap will unscrew. Such strength is not possessed by a large segment of the consuming public, such as senior citizens and children.

Another disadvantage of molded safety caps with break-away retainer skirts results from the narrow breakable connectors which extend outwardly from the main cap body to the skirt. When such connectors break, they can leave sharp remnants on the periphery of the cap, which remnants can cause pain and injury to delicate fingertips each time the cap is grasped to seal or unseal the container.

It is also known to produce tamper-proof caps by thermoforming techniques and to provide the retainer skirt with one or more tabs which project downwardly or inwardly from the skirt element, in a counterclockwise direction, so as to ride over and engage the ratchet retainer on the bottle neck when the cap is applied to the neck by clockwise rotation. Since the tabs have the same thickness as the remainder of the thermoformed cap and are attached thereto by means of a narrow hinge line, such tabs offer little resistance to the removal of the cap and thus provide advantages over other safety caps. However, the small tabs break away from the retainer skirt during initial removal of the cap and can fall into the container when the cap is lifted from the container or can remain on the neck of the container and fall into a glass or other receptacle into which the product is poured from the container.

SUMMARY OF THE INVENTION

The present invention relates to novel unitary tamper-proof caps, particularly thermoformed caps, comprising a main cap body and a retainer skirt joined to the main cap body by means of an annular horizontal flange, said flange being provided with one or more circumferential severance cuts which extend around the entire circumference of the main cap and the ends of which are separated from each other by a narrow uncut flange segment which forms a continuous unbroken bridge between the cap body and the retainer skirt, said bridge being flexible and weak in the direction of removal of the cap. The ends of the severance lines or cuts either overlap or extend outwardly from said circumferential cut in the direction of removal of the cap, and are closely spaced to provide yieldable interconnections which flex under the application of slight reverse rotational pressure to the cap element, to permit the main cap body to be unscrewed at least a slight distance while the skirt element remain locked to the container. Such relative movement, coupled with the weakened condition of the flange bridges in their flexed condition facilitates the breaking of the bridges at their most narrow point, which preferably is adjacent the cap element, and the separation of the cap into the main cap element and the retainer skirt element. After initial removal of the tamper-proof cap, the separated retainer skirt element is lifted out of engagement with the ratchet means on the bottle neck and is discarded, the severed bridge segments remaining attached thereto.

DETAILED DESCRIPTION OF THE DRAWING

Figure 1:
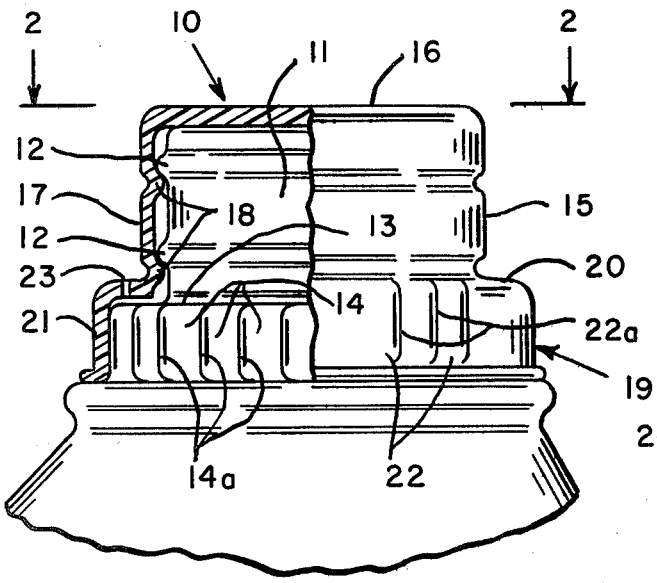
FIG. 1 is a side elevational view of a tamper-proof cap according to one embodiment of the present invention, the cap being illustrated in sealing position on a container and a portion of the cap being shown in cross-section for purposes of illustration.

FIG. 1 illustrates a thermoformed plastic safety cap 10 according to one embodiment of the present invention present in sealing engagement on a conventional plastic container neck 11 having cap-engaging threads 12 and a circumferential ratchet collar 13 below the threads 12 and containing a multiplicity of retainer projections or angular teeth 14 which are slanted or tapered in a counterclockwise direction when viewed from the top of the container.

The cap 10 comprises a main cap body 15 having a generally flat top surface 16 and a vertical skirt or side wall 17 having interior threads 18 which are adapted to engage the threads 12 on the container and permit the cap to be tightened thereon when the cap is turned in a clockwise direction, looking down on the container. The cap also comprises an annular retainer skirt 19 comprising a horizontal annular flange 20 which extends radially outwardly from the base of the side wall 17 of the main cap body 15 to a depending vertical skirt 21 which includes a multiplicity of inwardly-extending angular ratchet-engaging teeth 22 which are tapered in a direction opposite to the taper of the teeth 14 on the ratchet collar 13 of the container, i.e., in a clockwise direction, looking down on the container so as to permit smooth slip-over engagement between outwardly projecting ratchet 14 and inwardly-projecting cap teeth 22 when the cap is rotated clockwise and tightened onto the container, the radial edges 14*a* and 22*a* of the cap teeth and ratchet teeth respectively being such as to engage each other and restrain reverse-rotation or removal of the cap, as illustrated by the prior art.

Figure 2:
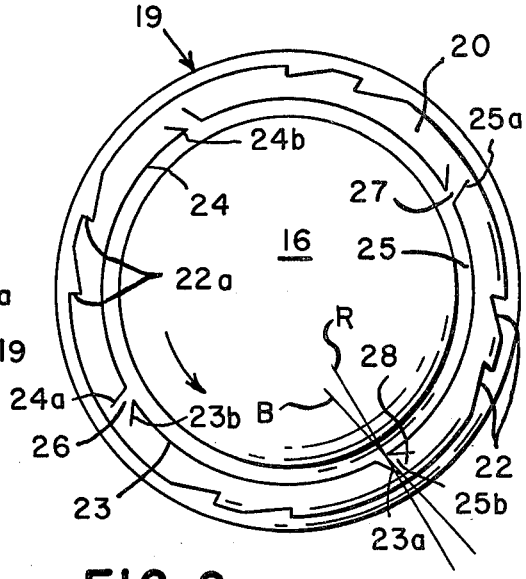
FIG. 2 is a view of the safety cap of FIG. 1 taken along the line 2—2 thereof.
Figure 3:
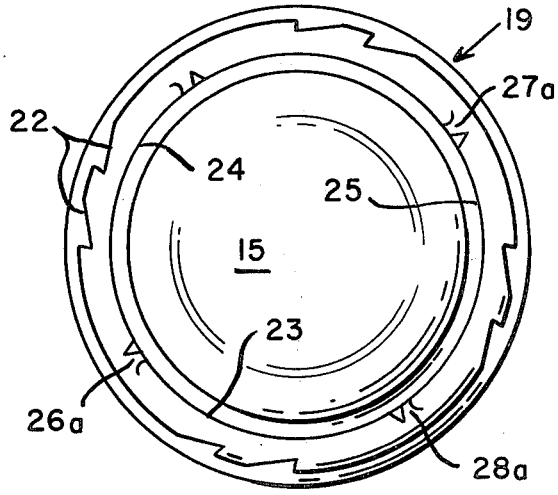
FIG. 3 corresponds to FIG. 2 but illustrates the condition of the cap when the main cap body is rotated counterclockwise during the initial opening of the container while the retainer skirt is locked onto the bottle neck ratchet.

The essential novelty of the tamper-proof cap 10 illustrated by FIGS. 1 and 2 resides in the discontinuous severance lines 23, 24 and 25 or cuts present in flange 20 which separate the cap 10 into the main cap body 15 and the retainer skirt 19, except for the bridging areas 26, 27 and 28 of the flange, which areas are formed by the outward and counter-clockwise extension of the leading ends 23*a*, 24*a* and 25*a* and trailing ends 23*b*, 24*b* and 25*b*, respectively, of each of the severance lines 23, 24 and 25. As illustrated by FIGS. 2 and 3, the severance lines taken together form a circumferential segmented circular cut around the entire flange 20. However, since the leading end of each of the severance lines does not meet but rather extends outwardly in closely-spaced relation to the trailing end of the next adjacent severance line, the main cap body 15 and the retainer skirt 19 are joined together as a unitary element by means of the weak, flexible bridging areas 26, 27 and 28 of the flange 20.

Preferably the ends of the severance lines 23, 24 and 25 overlap but such overlap need not be great, as illustrated by the slight overlap present in the embodiment of FIGS. 1 and 2. The formation of bridging areas which are flexible in the direction of removal of the cap is necessary to permit the main cap body 15 to be reverse-rotated a slight degree without much effort, while the retainer skirt 19 is locked onto the ratchet of the container and cannot move at all, and to cause the bridging areas 26, 27 and 28 to flex upwardly and to break as the main cap body 15 continues to be reverse-rotated or unscrewed with very little applied pressure or torque.

As illustrated by FIG. 2, the only connections between the main cap body 15 and the retainer skirt 19 are the bridging areas 26, 27 and 28 and these offer very little resistance to reverse rotation of the main cap body 15 because the outwardly extending ends of the severance lines 23, 24 and 25 are closely spaced to form a weak connection therebetween which extends in a generally counter-clockwise direction, i.e., if an imaginary line B is drawn between the most forward point or leading end 23*a* of one line, such as 23, and the most rearward point or trailing end 25*b* of the adjacent line 25, such imaginary line will extend in a generally counter-clockwise direction, relative to the radius R of the cap, indicating that the direction of weakness of the bridging area 26 is counter-clockwise, as shown in FIG. 2. If the severance lines do not overlap or if the bridging areas between the leading and trailing edges thereof do not extend in the direction of removal of the cap, the main cap body 15 cannot be reverse-rotated while the retainer skirt 19 is locked to the container until sufficient strength is applied to break the flange material between the ends of the severance lines. The flange material cannot flex upwardly to weaken and facilitate the breakage thereof since the direction of the closest approach of the leading end of each severance line to the trailing end of the adjacent severance line is not the same as the direction in which the main cap body is attempted to be moved during the unscrewing operation, i.e., it is either radial or clockwise.

Figure 4:
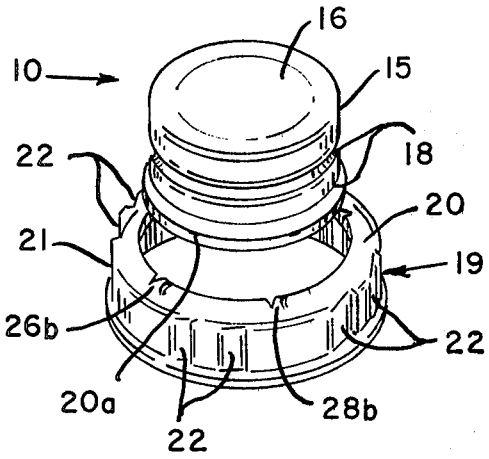
FIG. 4 is a perspective view of the main cap body and retainer skirt separated therefrom as a result of continued counterclockwise relative movement therebetween beyond the position illustrated by FIG. 3.

FIG. 3 illustrates the appearance of the cap assembly of FIGS. 1 and 2 after initial reverse-rotational pressure is applied to the main cap body 15. Relative movement occurs to cause the bridging areas to flex upward, as illustrated by 26*a*, 27*a* and 28*a*, but the elements 15 and 19 are still joined until the element 15 is further unscrewed to cause the flexed bridges to break at their most narrow areas, i.e., adjacent the main cap body, while remaining intact at their opposite ends. Thus, the broken bridges 26*b*, 27*b* (not shown) and 28*b* remain attached to the separated retainer skirt 19 while the narrow flange remnant 20*a* of the main cap body 15 is circular and has a relatively smooth edge free of projections, as illustrated by FIG. 4.

After the initial removal of the main cap body 15 from the container neck 11, the separated retainer skirt 19 is lifted out of engagement with the ratchet collar 13 of the container and is discarded along with the attached broken bridges. The cap 10 cannot be removed from the container without the separation of the main cap body 15 from the retainer skirt 19 and such separation is irreversible. Thus, a clear visible indication is provided to the original purchaser of the container that the container remains in its original sealed condition.

Figure 5:
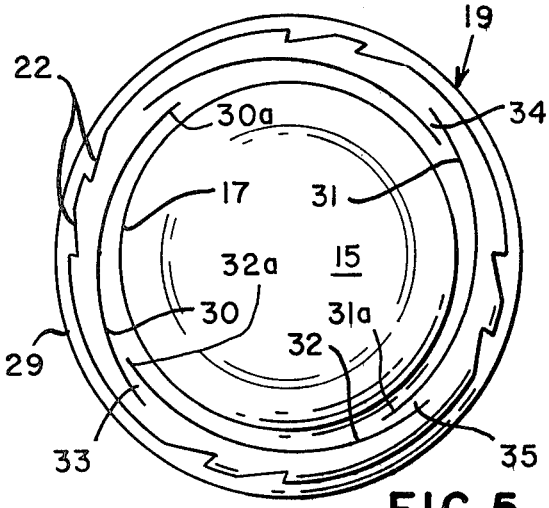
FIGS. 5 and 6 correspond to the view of FIG. 2 but illustrate severange lines and bridging areas having different configurations according to other embodiments of the present invention.
Figure 6:
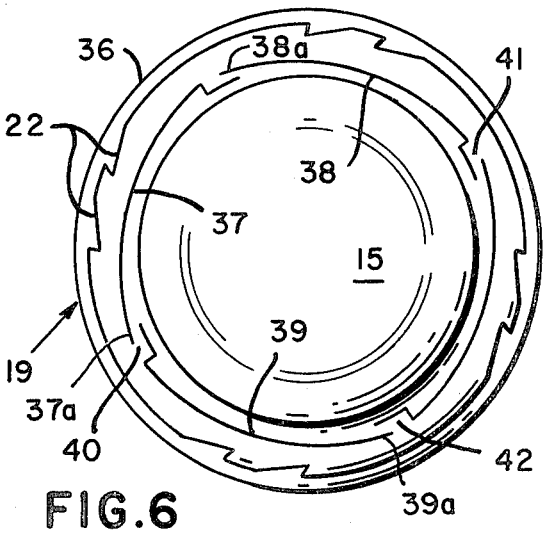

FIGS. 5 and 6 illustrate other embodiments of the present invention, characterized by severance lines and bridging areas of different shapes. These are less preferred than the embodiment of FIGS. 1 to 4, although they function in precisely the same manner thereto, because they do not provide flange remnants which are as smooth or circular as flange 20*a* of FIG. 4.

The cap assembly 29 of FIG. 5 corresponds to that of FIG. 2 except that the severance lines 30, 31 and 32 spiral slightly outwardly in a counterclockwise direction relative to the circular side wall 17 of the main cap body 15 to provide narrow bridging areas 33, 34 and 35 which increase in width in the counterclockwise direction. Thus, the narrowest and weakest portion of each of said bridging areas is adjacent the trailing end 30*a*, 31*a* and 32*a*, respectively, of each of the severance lines 30, 31 and 32 and preferably very closely spaced from the base of the main cap body so that little or no flange material remains on the main cap body after separation of the retainer skirt element. It is at their narrowest point that the bridging areas are weakest and break during initial removal of the main cap body.

The cap assembly 36 of FIG. 6 is similar to that of FIG. 5 except that the severance lines 37, 38 and 39 thereof are not smooth spiral cuts but rather are notched inwardly at the leading edges 37*a*, 38*a*, and 39*a*, respectively, of each in order to extend inwardly of and overlap with the trailing edge of the next adjacent severance line to provide narrow bridging areas 40, 41 and 42, as illustrated. Reverse rotation of the main cap body 15, relative to the retainer skirt 19, causes breakage of the bridging areas 40, 41 and 42 and separation of the cap 36 into the cap body 15 and the retainer skirt 19.

The present tamper-proof caps preferably are produced by conventional thermoforming methods using sheets of polystyrene, polyethylene, polypropylene or other thermoformable film having a suitable thickness, such as about 30 mils, and using dies provided with cutter projections which produce the overlapping severing lines in the flange 20. However, the severing lines may be produced by means of cutter tools after the cap is originally molded. Also, the present caps may be injection molded in conventional manner using dies which produce the overlapping severance lines on the flange 20 as the cap is molded, thereby avoiding the necessity of cutting such lines into the flange 20 as a separate operation.

Variations and modifications may be made with respect to the number of severance lines formed on the present cap flange and the relative shapes of such severance lines, provided that the ends of such lines overlap or otherwise form narrow uncut bridging areas of flange material therebetween having a flexibility and weakness in the direction of removal of the cap. Most preferably, the leading edge of each severance line extends inwardly of the tailing edge of the next adjacent severance line, i.e., closer to the side wall 17 of the main cap body 15, and the bridging areas are most narrow adjacent the leading edge of each of the severance lines so that the bridging areas flex away from the cap body 15 and towards the retainer skirt 19 during the initial removal of the cap. This causes the bridging areas to break adjacent the main cap body and to remain attached to the separated retainer skirt element which is discarded.

Other variations and modifications, within the scope of the appended claims, will be apparent to those skilled in the art in the light of the present disclosure.

I claim:

1. A tamper-proof thermoformed plastic cap which is adapted to be applied in unitary form to a container neck having an engagement thread and a retainer means associated with said thread but which is resistant to removal in unitary form from said container neck, comprising a main cap body having a top surface and a cylindrical side wall extending downwardly from said top surface and having an internal thread for engaging the thread on said neck to seal said container, and an annular retainer skirt element which is coaxial with and has a larger diameter than said main cap body, said retainer skirt element having a top surface comprising an annular horizontal flange extending radially from the base of said cap body and a cylindrical vertical side wall extending downwardly from the outer edge of said flange, said side wall being provided with engagement means adapted to slip over the retainer means present on the container when said cap is rotated onto the threaded neck to seal said container but to resist counter-rotation of said cap, characterized by said annular flange being provided with a plurality of transverse severance lines, said lines forming a segmented cut in said flange at a location closely spaced from the base of said main cap body, the leading end of each of said lines extending outwardly from said segmented cut in the direction of removal of said cap to form a narrow bridging area of said flange which is flexible upwardly, relative to the horizontal flange and in the direction of removal of said cap to permit slight relative movement between said main cap body and said retainer skirt when said main cap body is reverse rotated, whereby when the cap is engaged on a container opening and reverse-rotational pressure is applied thereto, the retainer skirt element remain engaged by said retainer means while the main cap body can be rotated sufficiently to cause each said bridging area to flex and break, thereby permanently separating said cap into said main cap body and said retainer skirt element the first time the cap is removed from the container.

2. A cap according to claim 1 in which said engagement means present on the side wall of the retainer skirt element comprises one or more inward projections which are adapted to slide over said retainer means present on said container, comprising a plurality of teeth which are angular in a clockwise direction when viewed from above, said projections being resistant to movement past said angular teeth in a counter-clockwise direction.

3. A cap according to claim 1 in which each bridging area increases in width in a counter-clockwise direction when viewed from above, whereby the narrowest and weakest portion of each bridging area is the portion closest to the main cap body and each broken bridging area remains attached to the retainer skirt element.

4. A method for forming a safety-seal cap adapted to be applied in unitary form to a container opening having a threaded neck and a retainer means associated with said threaded neck but being resistant to removal in unitary form from said container, comprising the step of thermoforming a sheet of plastic material into a unitary cap having a main cap body having a top surface and a cylindrical side wall extending downwardly from said top surface and having internal threads for engaging the threaded neck of said container, and an annular retainer skirt element which is coaxial with and has a larger diameter than said main cap body, said retainer skirt element having a top surface comprising an annular horizontal flange extending radially from the base of said cap body and a cylindrical vertical side wall extending downwardly from the outer edge of said flange, said side wall being provided with engagement means adapted to slip over the retainer means present on the container when said cap is rotated onto the threaded neck on the container but to resist counter-rotation of said cap, and cutting through said annular flange a plurality of transverse severance lines, said lines forming a segmented cut in said flange at a location closely spaced from the base of said main cap body, the leading end of each of said lines extending outwardly from said segmented cut in the direction of removal of said cap to form a narrow bridging area of said flange which is flexible upwardly, relative to the horizontal flange and in the direction of removal of said cap to permit slight relative movement between said main cap body and said retainer skirt when said main cap body is reverse rotated, whereby when the cap is engaged on a container opening and revise-rotational pressure is applied thereto, the retainer skirt element remains engaged by said retainer means while the main cap body can be rotated sufficiently to cause each said bridging area to flex and break, thereby permanently separating said cap into said main cap body and said retainer skit element the first time the cap is removed from the container.

5. A method according to claim 4 in which said unitary cap is thermoformed from a continuous sheet of plastic and each said severance line is formed by cutting through said annular flange by means of a cutting die.

6. A method according to claim 4 in which said unitary cap is injection molded using a die which forms each said severance line in situ.

* * * * *

UNITED STATES PATENT AND TRADEMARK OFFICE

CERTIFICATE OF CORRECTION

PATENT NO. : 4,225,050

DATED September 30, 1980

INVENTOR(S) : DOUGLAS M. REINHART

It is certified that error appears in the above-identified patent and that said Letters Patent are hereby corrected as shown below:

Col. 2, line 68, "severange" should be --severance--; Col. 5, line 39 "tailing" should be --trailing--; Col. 6, line 18 "remain" should be --remains--; Col. 8, line 1 "skit" should be --skirt--.

Signed and Sealed this

*Ninth* Day of *December 1980*

[SEAL]

*Attest:*

SIDNEY A. DIAMOND

*Attesting Officer*

*Commissioner of Patents and Trademarks*